United States Patent [19]

Parker

[11] Patent Number: 5,027,487

[45] Date of Patent: Jul. 2, 1991

[54] GENEVA MECHANISM CONTROL FOR WIRE DISPLACEMENT

[75] Inventor: E. Theodore Parker, Arcadia, Calif.

[73] Assignee: Eubanks Engineering Company, Monrovia, Calif.

[21] Appl. No.: 543,544

[22] Filed: Jun. 26, 1990

[51] Int. Cl.[5] ..... H01R 43/04

[52] U.S. Cl. ..... 29/33 M; 29/564.4

[58] Field of Search ..... 29/33 M, 564.4, 566.2, 29/564.6, 753, 747; 81/9.51; 140/105, 139, 140; 198/468.2, 470.1; 72/405, 162; 226/113, 137, 139, 142, 44, 45

[56] References Cited

U.S. PATENT DOCUMENTS

| | | | |
|---|---|---|---|
| 2,954,599 | 10/1960 | Cootes | 29/33 M |
| 3,804,603 | 4/1974 | Wion | 29/566.2 X |
| 4,506,566 | 3/1985 | Schmid | 81/9.51 |
| 4,513,794 | 4/1985 | Witte | 72/162 X |
| 4,561,155 | 12/1985 | Randar et al. | 29/564.4 X |
| 4,653,160 | 3/1987 | Thorkildsen | 29/33 M |
| 4,672,871 | 6/1987 | Gudmestad | 29/564.4 X |
| 4,713,880 | 12/1987 | Dusel et al. | 29/504.4 |

FOREIGN PATENT DOCUMENTS

| | | | |
|---|---|---|---|
| 50910 | 5/1982 | European Pat. Off. | 29/564.4 |

*Primary Examiner*—William Briggs
*Attorney, Agent, or Firm*—William W. Haefliger

[57] ABSTRACT

An apparatus for processing wire subject to displacement, comprising first means including a first Geneva mechanism for rotatably displacing the wire to alter its endwise orientation; second means including a second Geneva mechanism for displacing the wire endwise; and drive means for driving the two mechanisms in such relation that the wire is displaced endwise by a carrier part of the second means during a dwell period of the first mechanism.

11 Claims, 11 Drawing Sheets

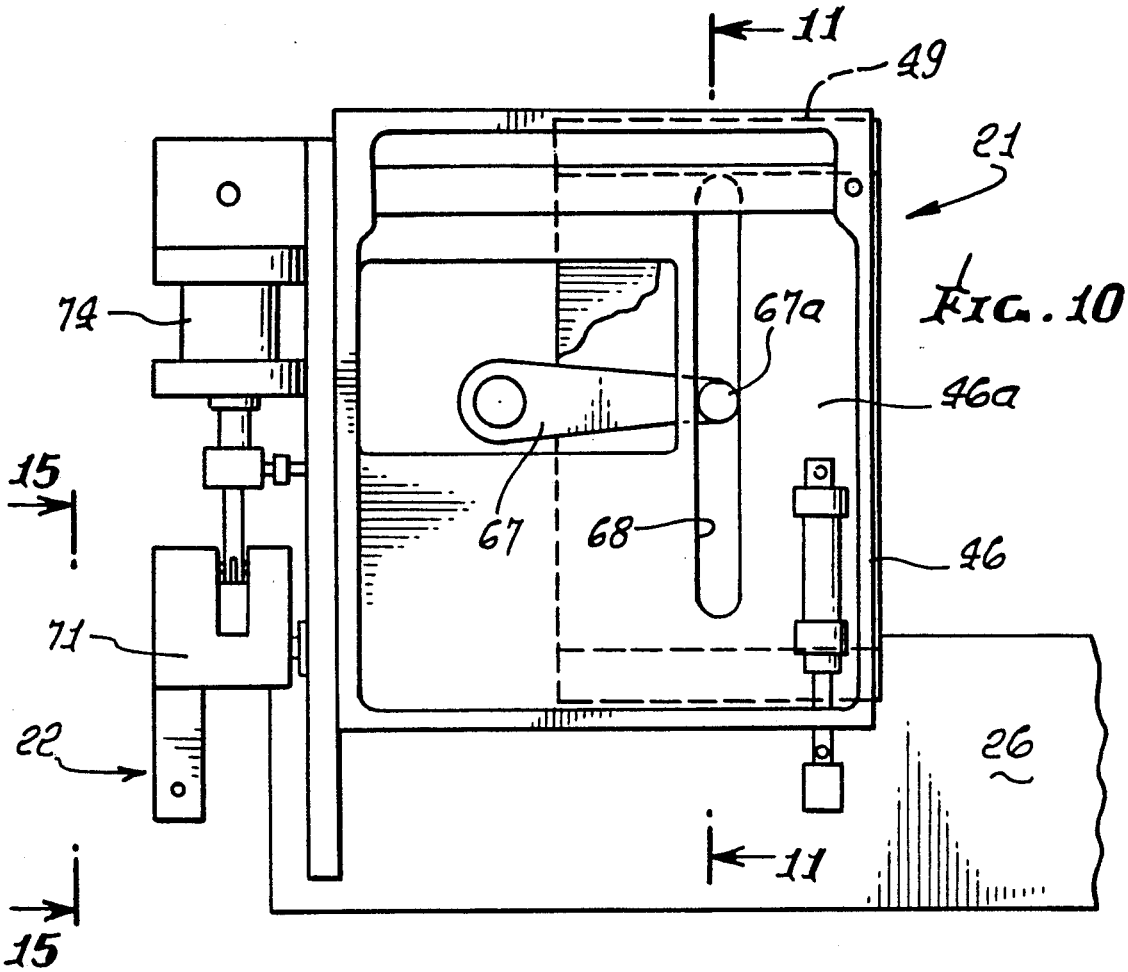
FIG. 10.
FIG. 12.
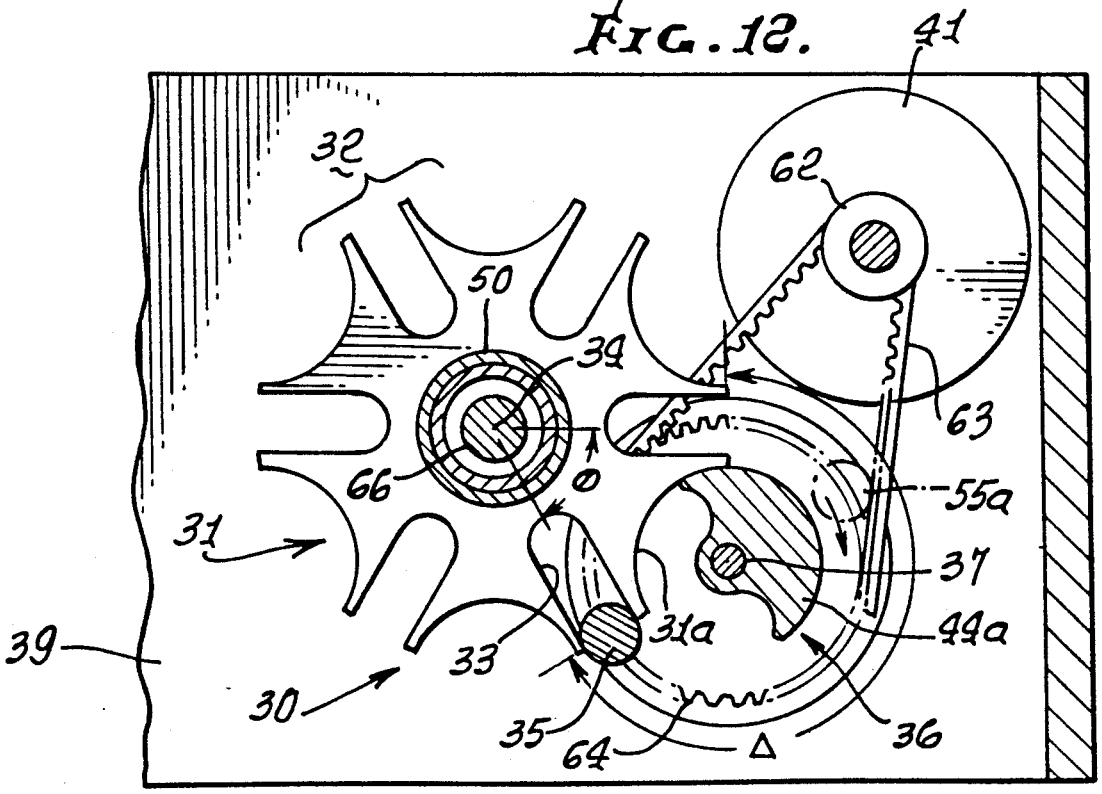

FIG. 15.
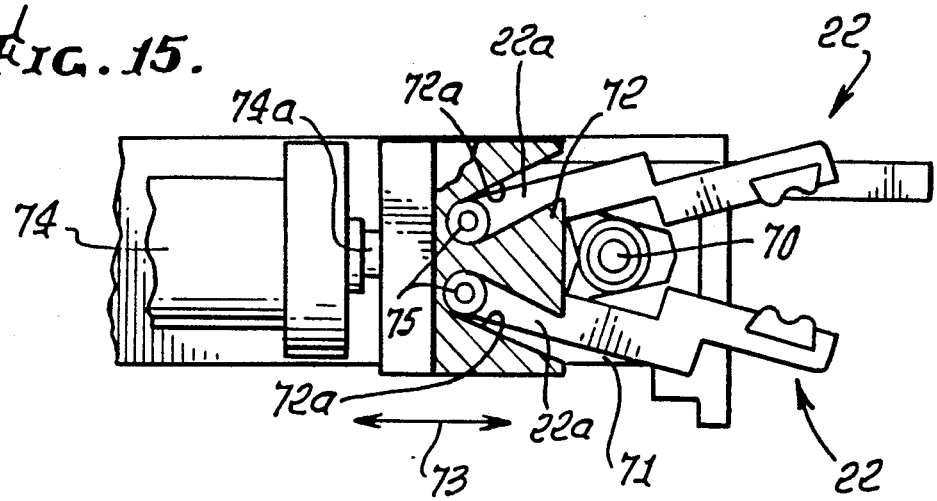
FIG. 16.
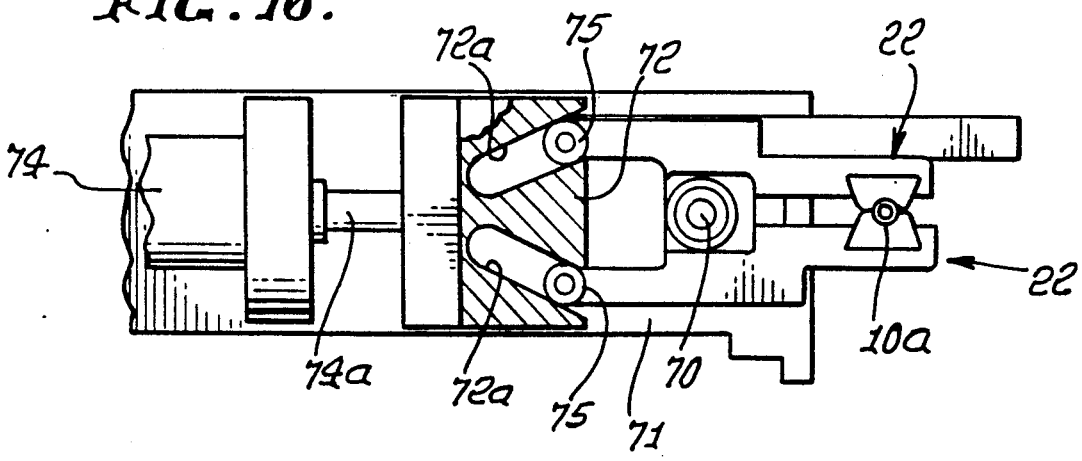
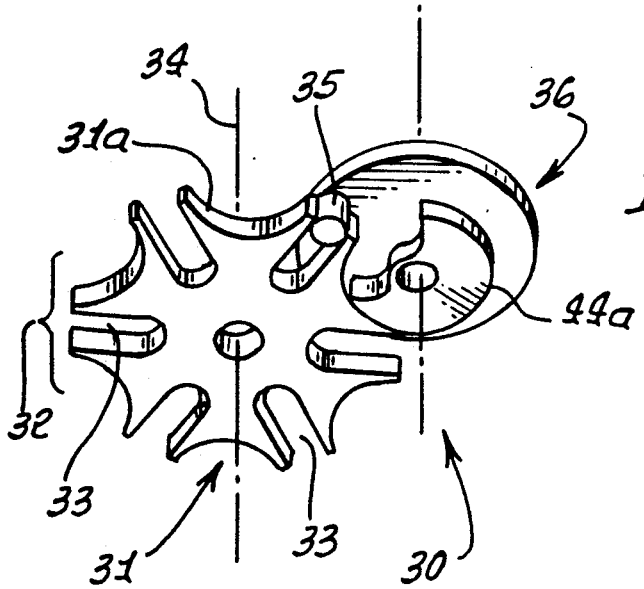
FIG. 17.

GENEVA MECHANISM CONTROL FOR WIRE DISPLACEMENT

BACKGROUND OF THE INVENTION

This invention relates generally to processing of wire, such as wire having sheathing or insulation, and more particularly concerns apparatus for transporting wire prior to, during and after application of terminals to ends of the wire section which have been stripped of sheathing or insulation.

In the past, wires and wire sections were commonly moved or transported during their processing as by linear actuators whose movements were physically stopped at the ends of actuator travel, for precision location of wire ends, as during cutting or application of metal terminals on stripped ends. During high speed reciprocating operation of the parts of the apparatus, the rapid stopping of the actuators produced high deceleration stoppage of moving parts, which led to excessive wear, noise, unacceptable malfunctioning as well as down-time. Need has, therefore, developed for ways to eliminate such wear, malfunctioning and downtime of the apparatus, and to otherwise simplify such apparatus and its operation.

SUMMARY OF THE INVENTION

It is a major object of the invention to provide wire processing apparatus which overcomes the above problems and meets the expressed needs. In accordance with such objective, the invention provided basically comprises:

a) first means including a first Geneva mechanism for rotatably displacing the wire to alter its endwise orientation, b) second means including a second Geneva mechanism for displacing the wire endwise, c) and drive means for driving the two mechanisms in such relation that the wire is displaced endwise by a carrier part of the second means during a dwell period of the first mechanism.

As will be seen, the invention enables both linear and angular controlled displacement of wire, and wire ends, which have been stripped, and precision location of such ends, as for application of terminals, all without employing stops that receive impact to limit and position actuators.

It is a further object to provide each of the Geneva mechanisms with driving and driven parts characterized in that the driven parts of both mechanisms are rotated during operation of the first Geneva mechanism to rotate the wire to alter its endwise orientation, and the driven part of the first Geneva mechanism dwells during operation of the second Geneva mechanism to displace the wire endwise. Such Geneva mechanisms, and in particular their slotted rotors, are typically coaxially driven.

It is yet another object to provide driving mechanism that includes a reversible drive for simultaneously driving the driven parts of both Geneva mechanisms sequentially forwardly and reversely whereby the wire is:

i) rotatably displaced counterclockwise, ii) then advanced endwise, iii) then retracted endwise, iv) and finally rotatably displaced clockwise.

Yet another object is to provide a wire transporting means including a slide, a shaft to rotate the slide in response to rotation of one Geneva mechanism rotor, and a cam device to extend and retract the slide, linearly, in response to rotation of the other Geneva mechanism rotor.

A further object is to so relate the drives of two Geneva mechanisms, wire advancement, and the operation of two wire terminating drives, as to achieve termination of opposite ends of successive wire sections, all without impacts and wear, as referred to.

These and other objects and advantages of the invention, as well as the details of an illustrative embodiment, will be more fully understood from the following specification and drawings, in which:

DRAWING DESCRIPTION

FIG. 1 is an overall schematic block plan view of a wire handling system embodying the invention;

FIG. 1*a* is a view showing a wire with opposite end terminations;

FIG. 1*a'* shows a stripped wire end;

Figure 2:
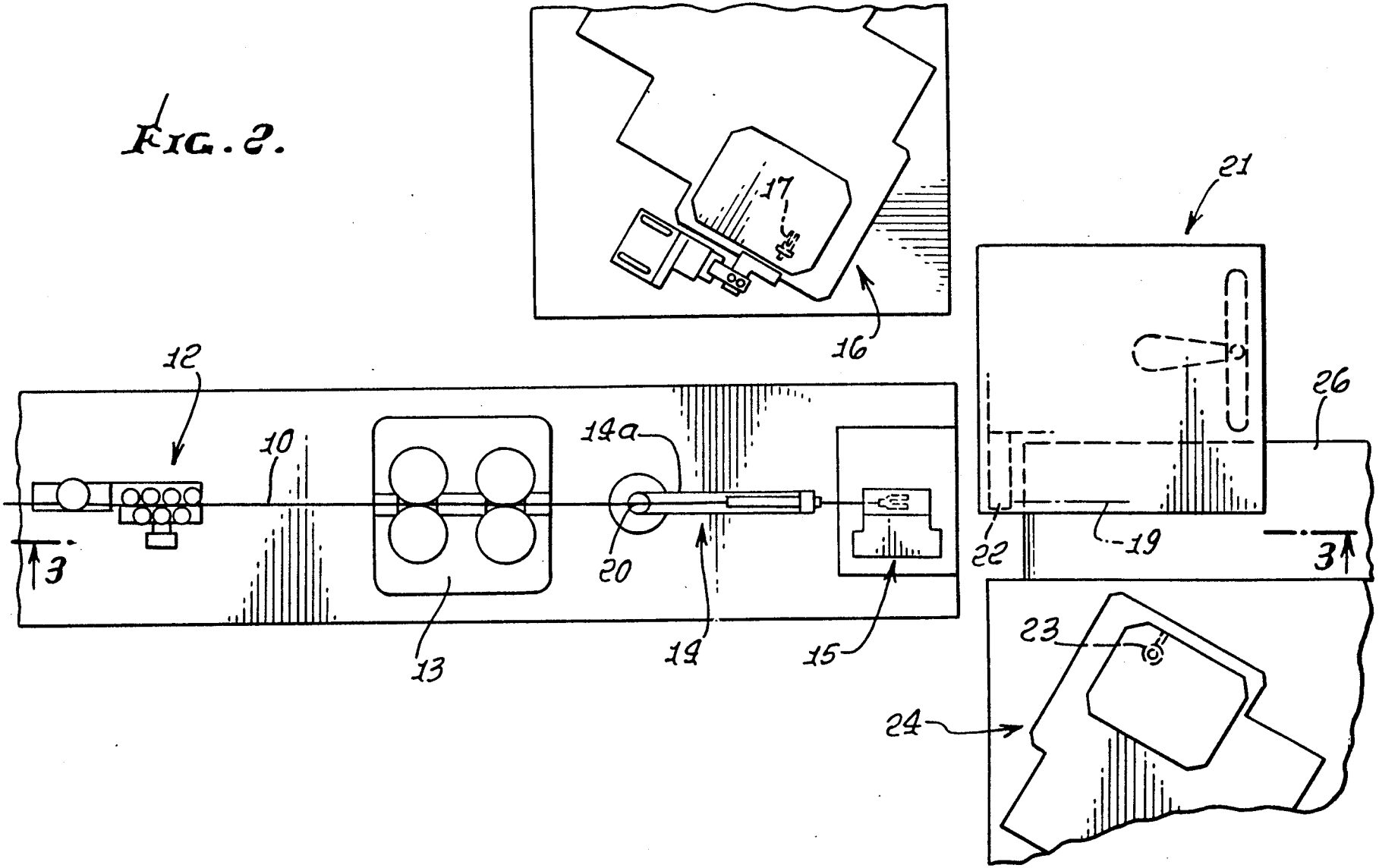
FIG. 2 is a schematic plan view of a portion of FIG. 1 enlarged to show more detail and showing a first step in a sequence of operations.
Figure 3:
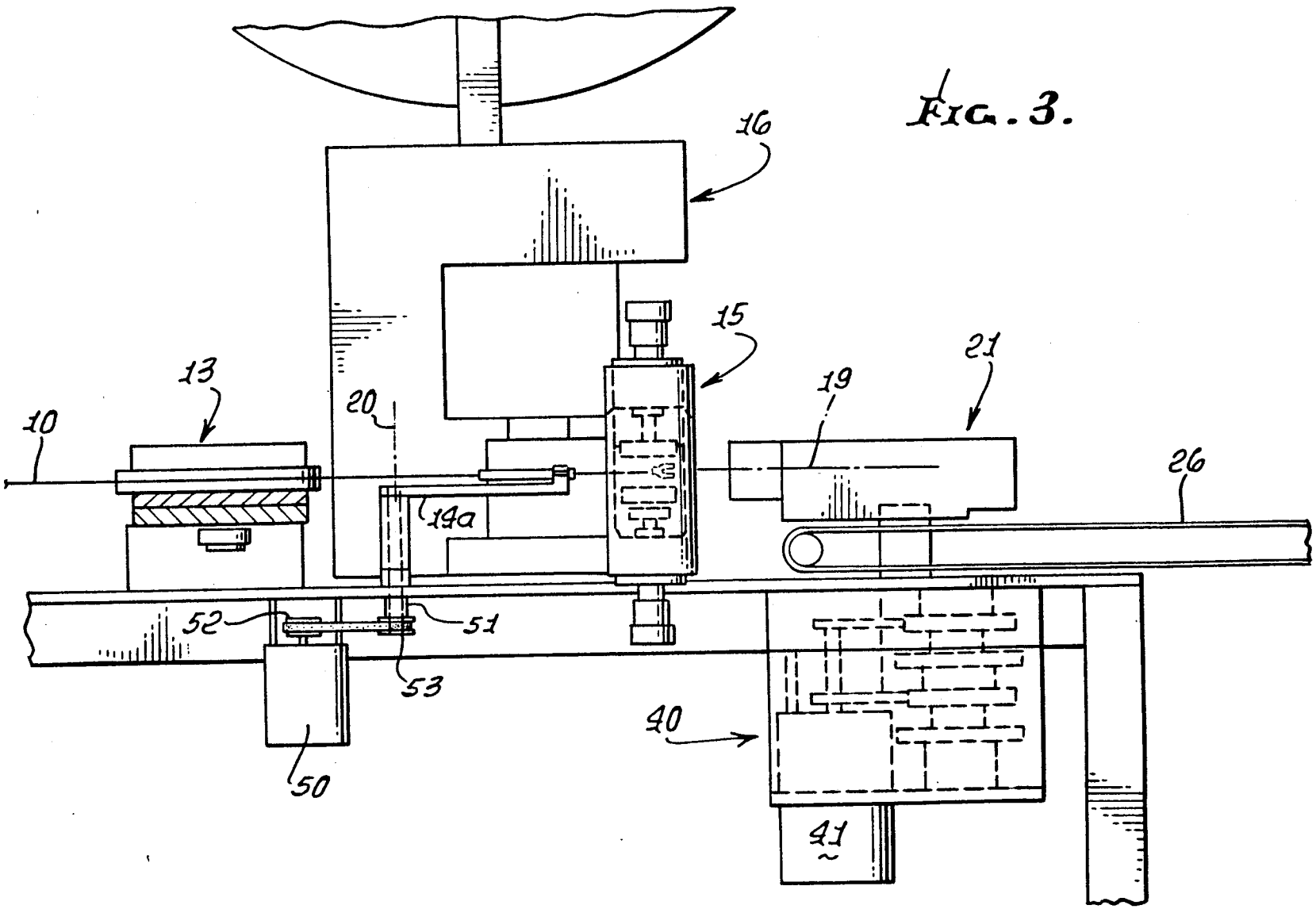
FIG. 3 is a section taken in elevation on lines 3—3 of FIG. 2.
Figure 5A:
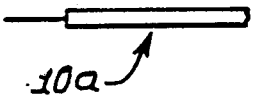
FIG. 5 is a view like FIG. 4 showing a third step in the operation sequence.
Figure 5:
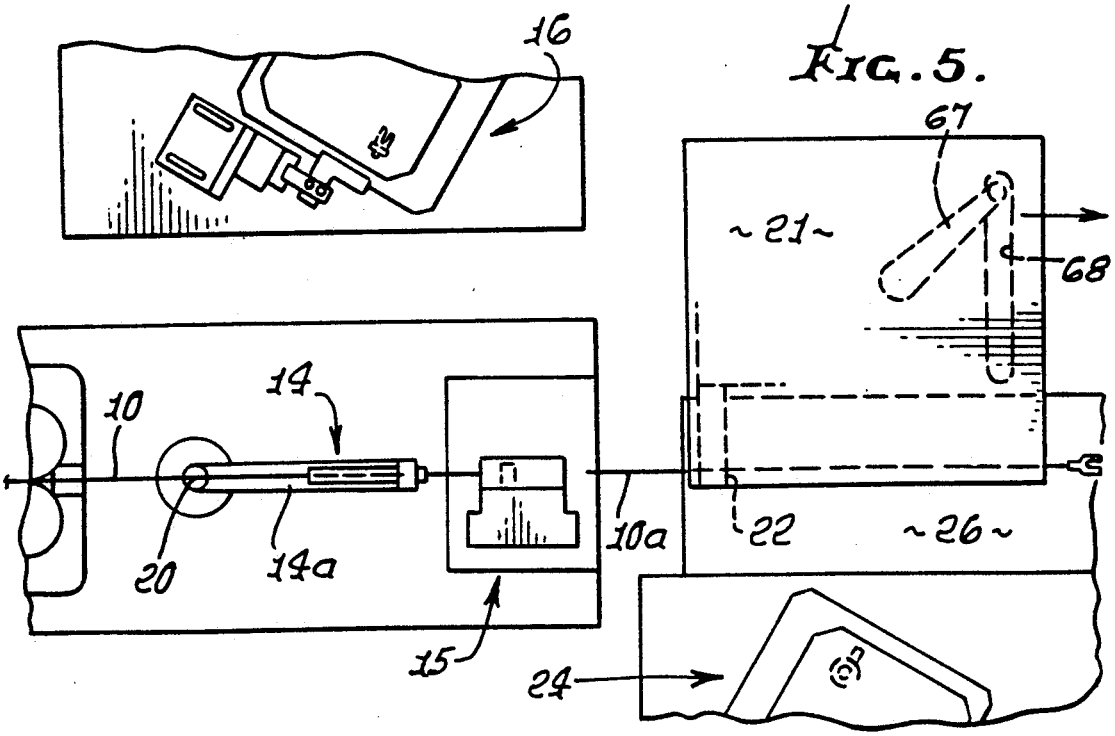
Figure 6:
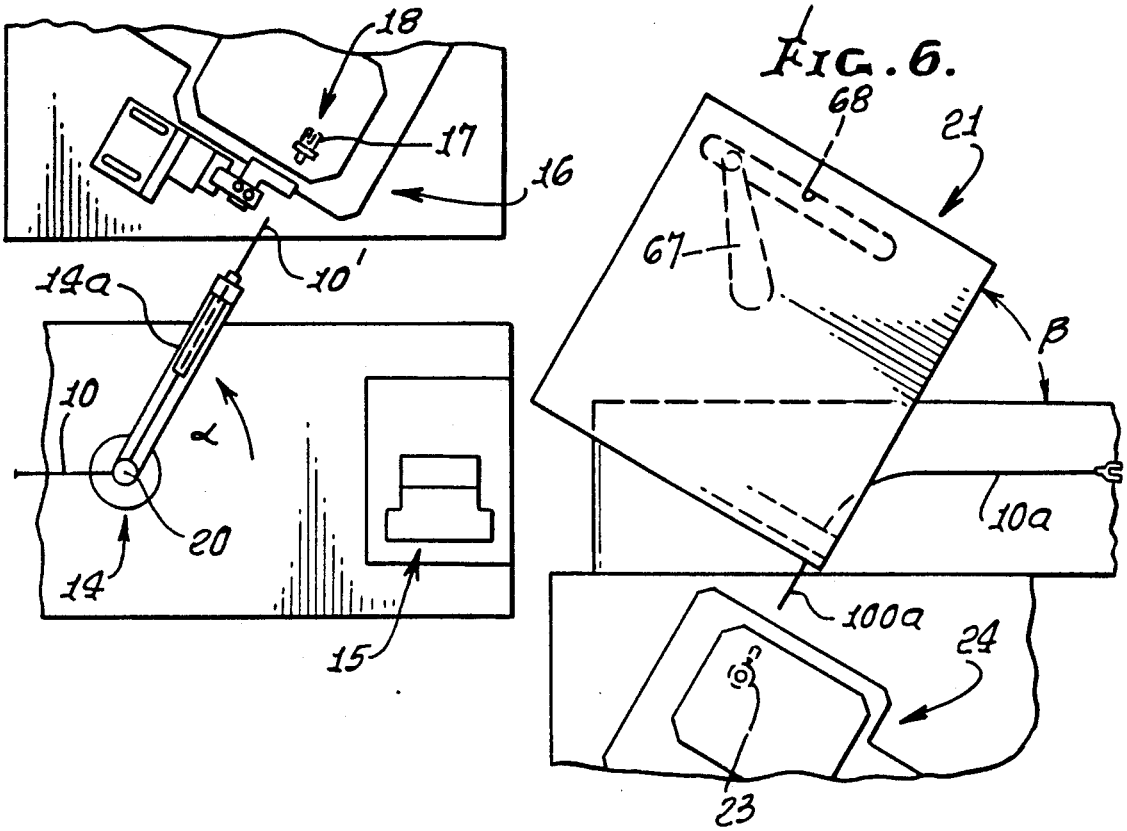
Figure 7:
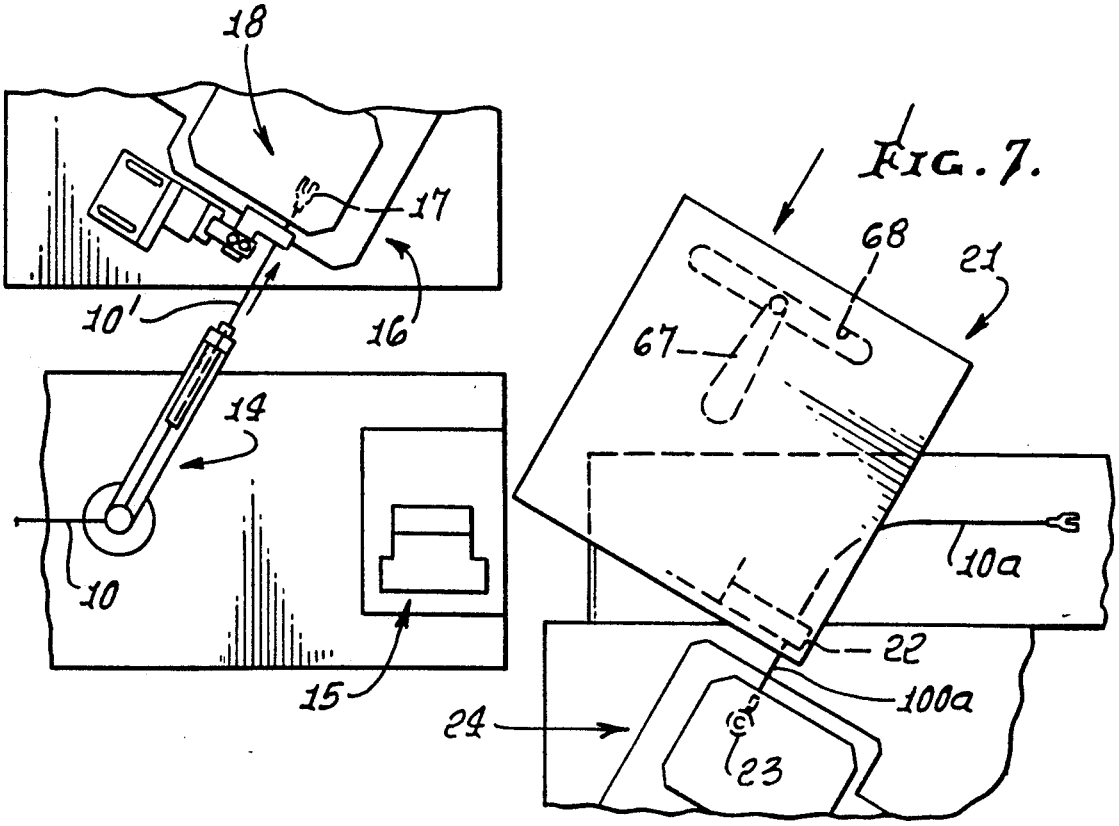
Figure 8:
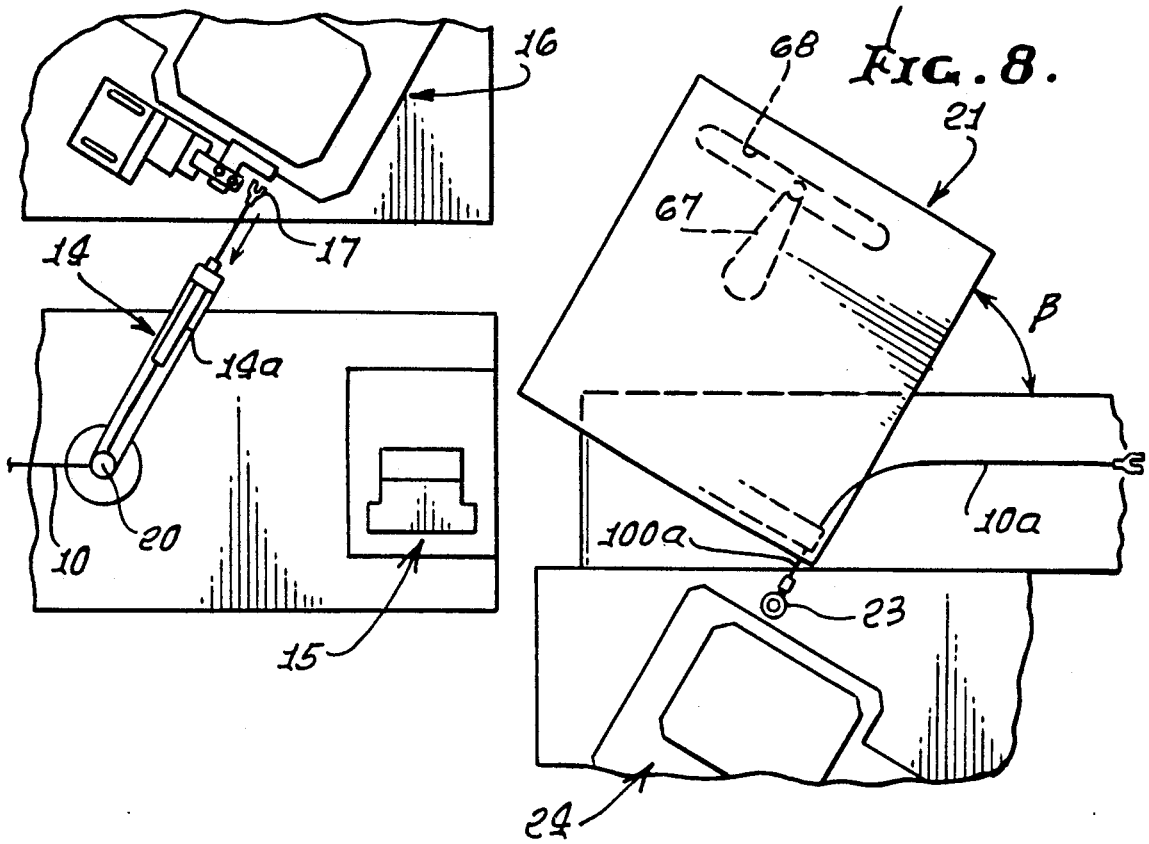
Figure 9:
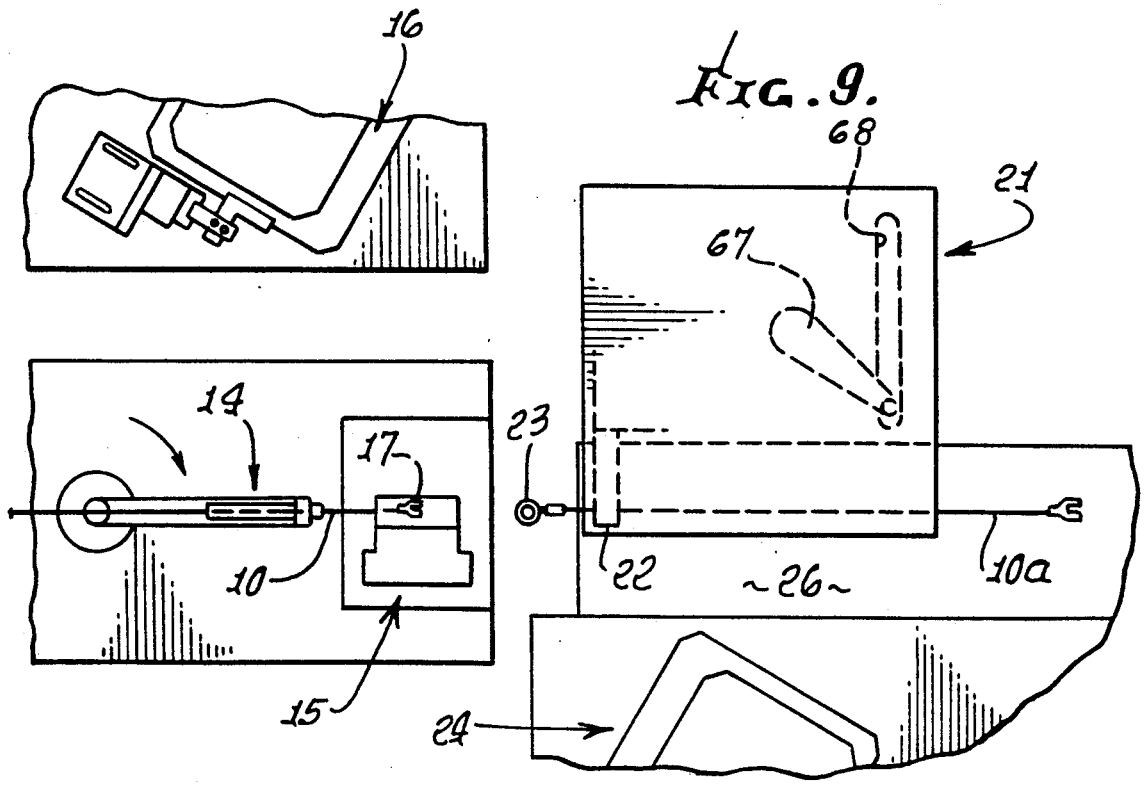
Figure 11:
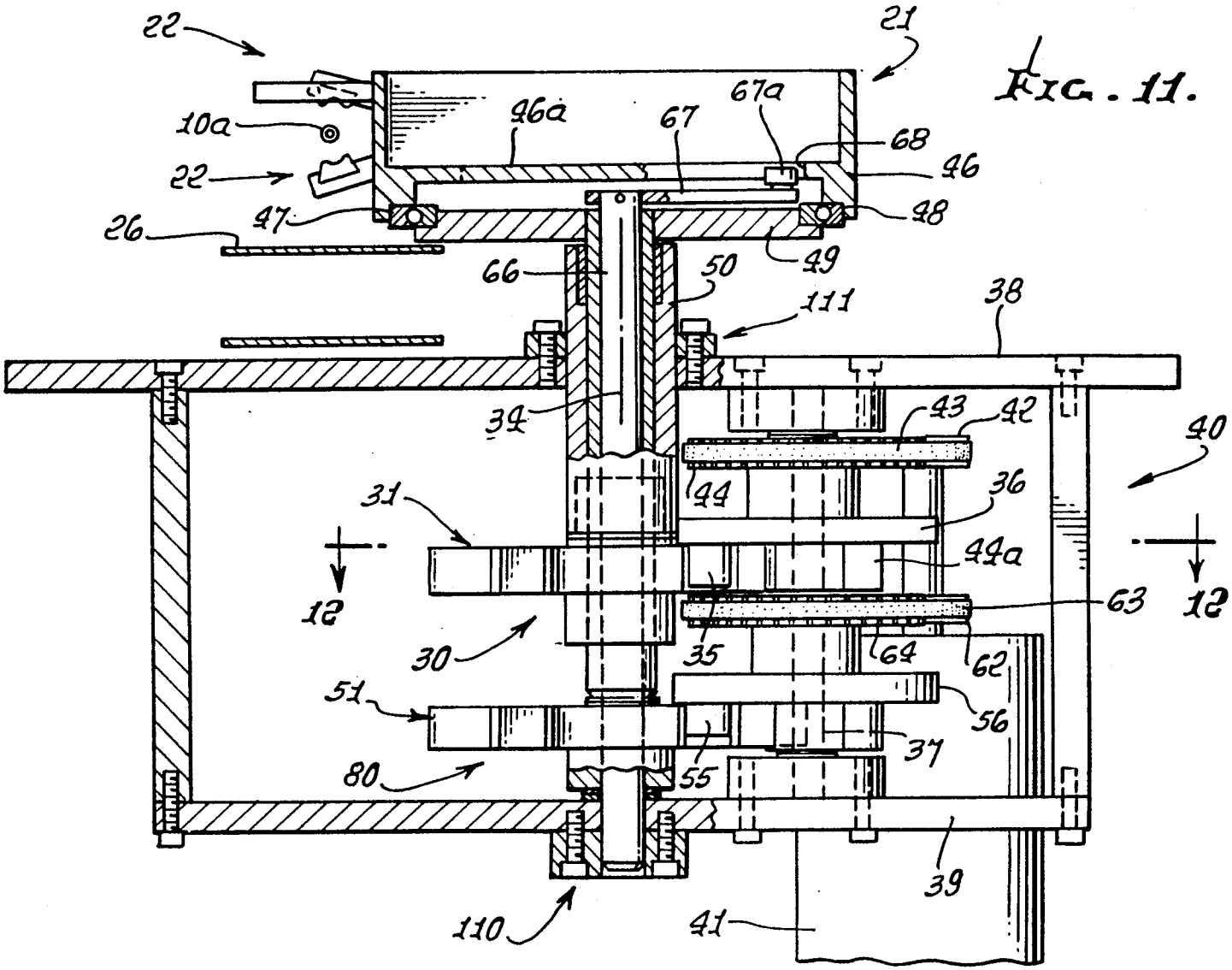
Figure 13:
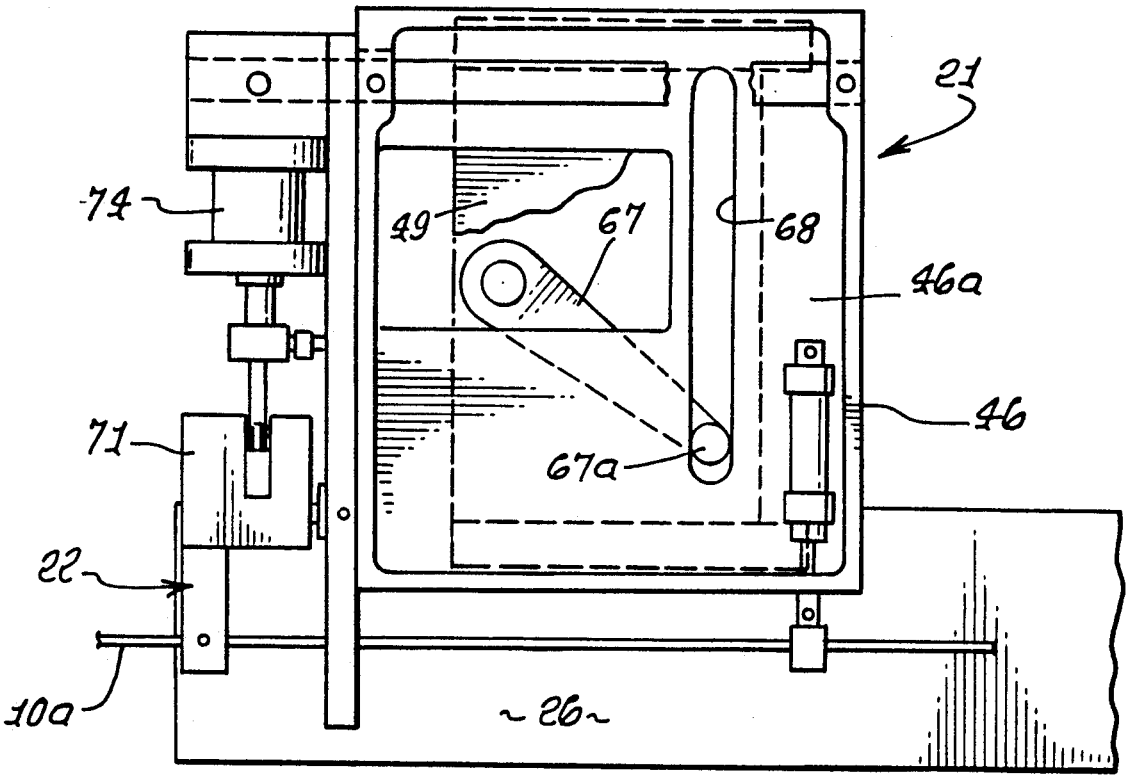
Figure 14:
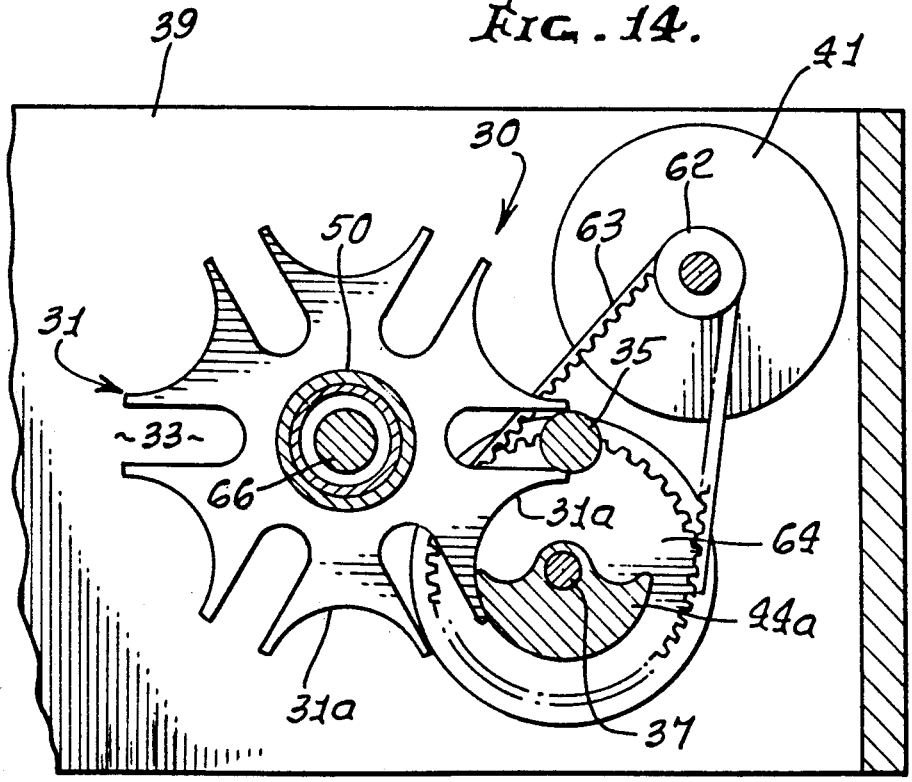

FIG. 5*a* is a fragmentary view of a section of stripped wire;

FIG. 6 is a view like FIG. 5 showing a fourth step in the operation sequence;

FIG. 7 is a view like FIG. 6 showing a fifth step in the operation sequence;

FIG. 8 is a view like FIG. 7 showing a sixth step in the operation sequence;

FIG. 9 is a view like FIG. 8 showing a seventh step in the operation sequence;

FIG. 10 is a plan view of the "final" robot seen in FIG. 2 but enlarged to show further detail;

FIG. 11 is an elevation taken in section on lines 11—11 of FIG. 10;

FIG. 12 is a plan view taken in section on lines 12—12 of FIG. 11;

FIG. 13 is a view like FIG. 10 but showing the "first" robot mechanism in FIG. 5 position;

FIG. 14 is a view like FIG. 12 but showing a Geneva wheel rotated 60° to rotate the "final" robot;

FIG. 15 is an enlarged plan view taken on lines 15—15 of FIG. 10 and showing a pair of wire gripping jaws in open position;

FIG. 16 is a view like FIG. 15 showing the jaws in closed, wire gripping position;

FIG. 17 is a perspective view of a Geneva wheel and its device; and

Figure 18:
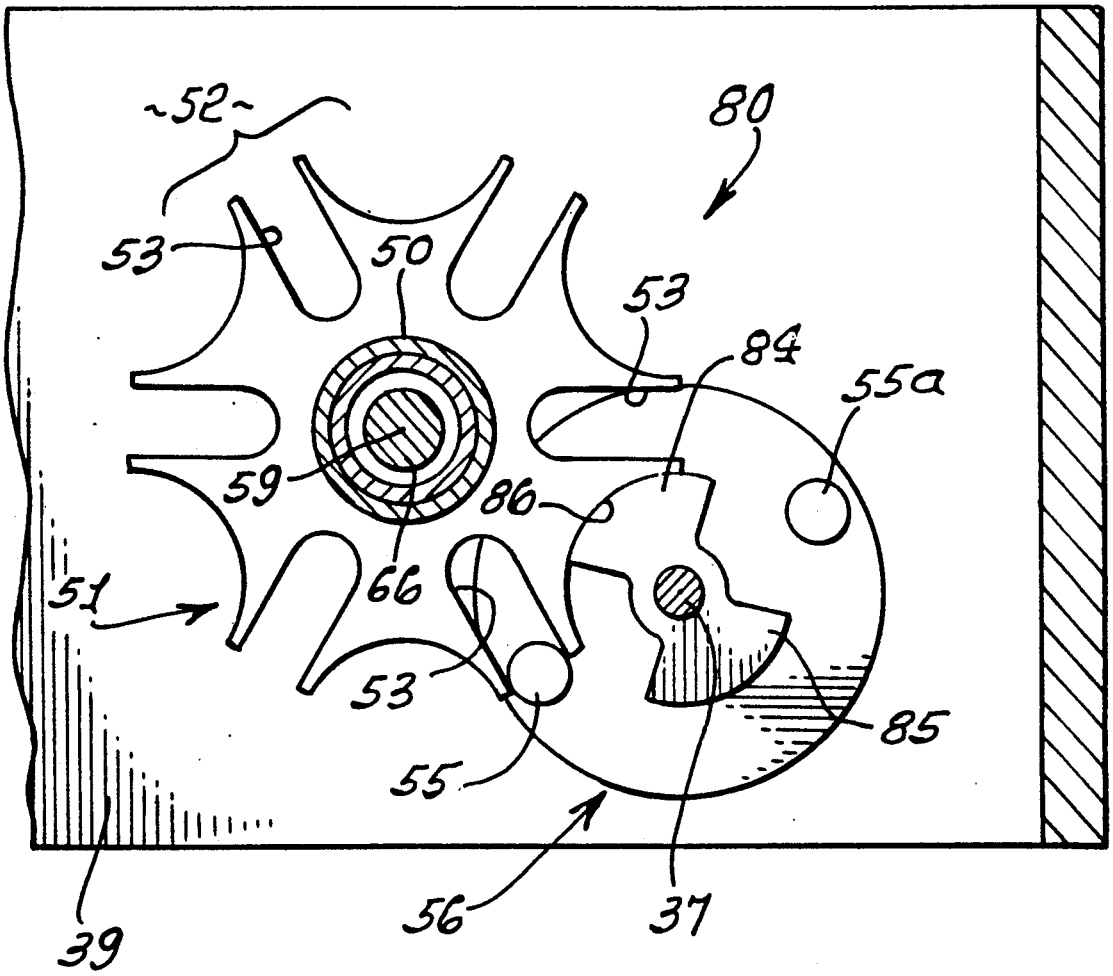

FIG. 18 is a plan view of the second Geneva device rotor.

GENERAL DESCRIPTION

Figure 1:
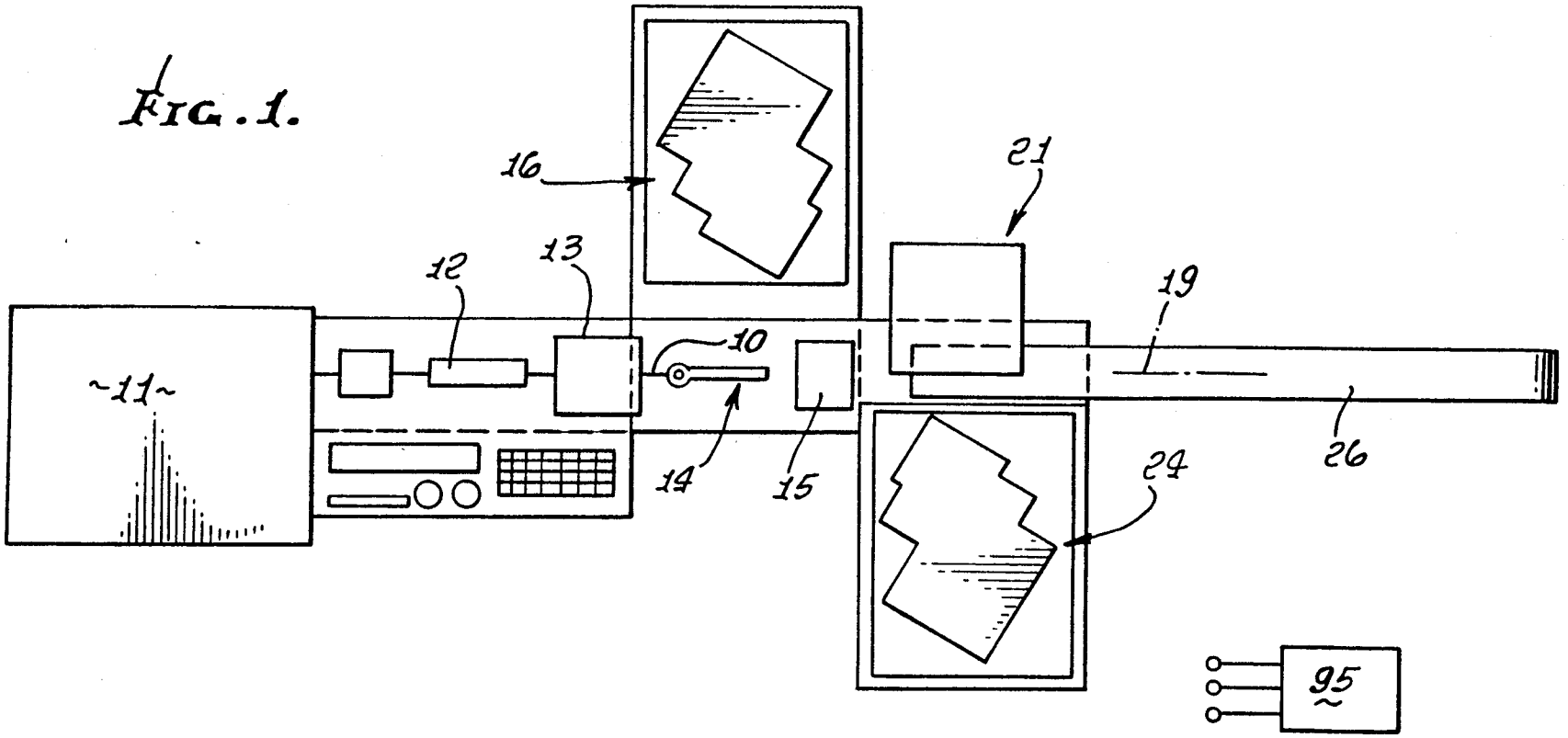
Figure 1A:
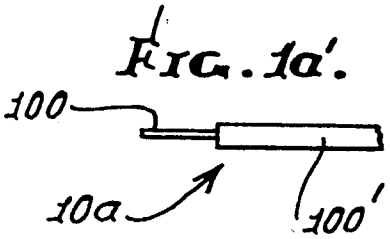
Figure 1A:
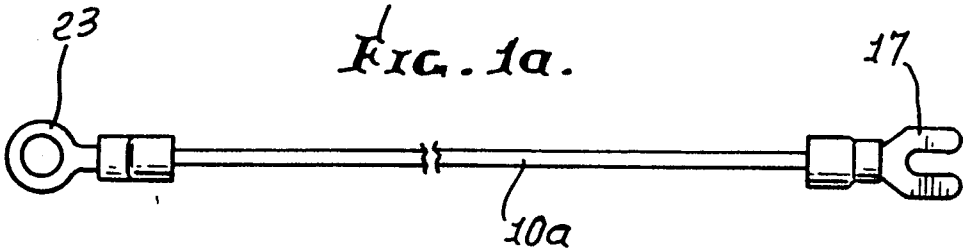
Figure 4:
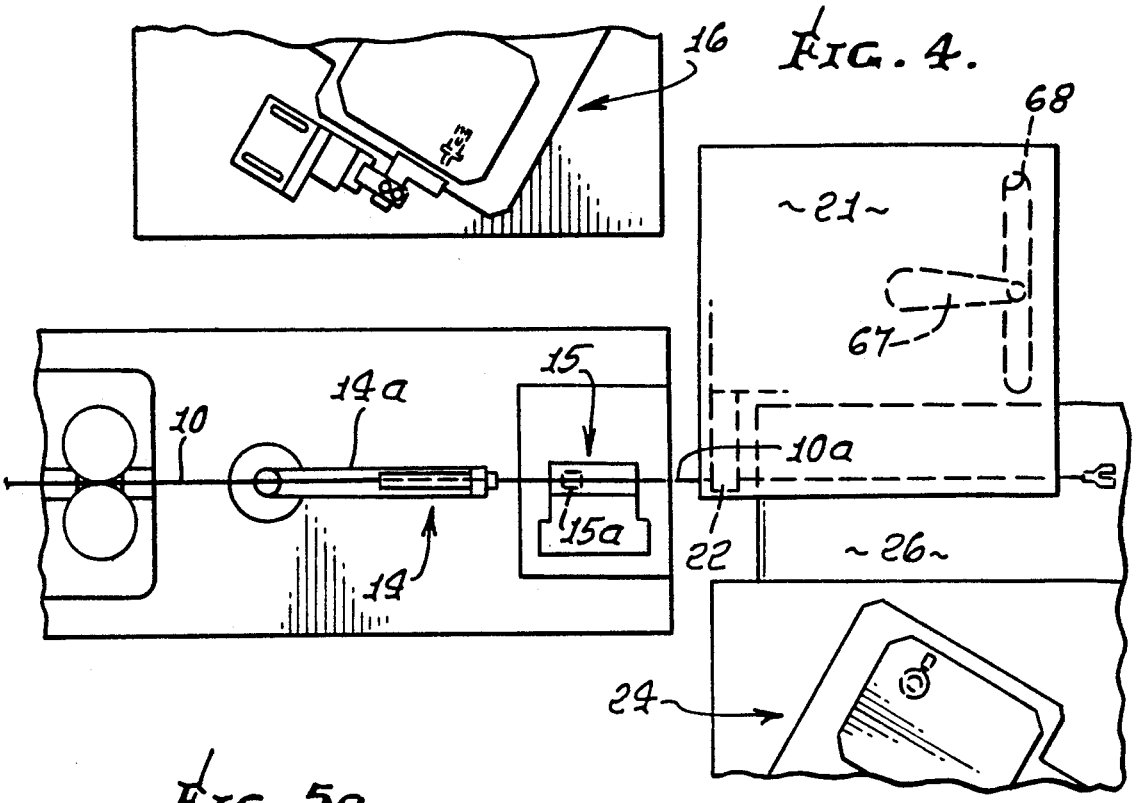
FIG. 4 is a view like FIG. 2 showing a second step in the operation sequence.

Referring first to FIG. 1, wire 10 is fed to the right, along an axis 19 from a supply station 11, to a wire straightener mechanism 12, and then to a feed mechanism 13. These mechanisms are known, and are also shown in FIG. 2. See for example U.S. Pat. No. 4,446,615 to Talley. The wire is then fed to a first (upstream) wire director robot 14 which passes the wire through it to a cutter station 15, where the end of the wire is severed or cut, as indicated in FIGS. 4 and 5. See cutter blade 15*a* in down position in FIG. 4. A previously advanced length or section 10*a* of wire is shown in FIG. 5, as pulled forwardly of the cutter station, after cutting, as shown in FIG. 5. FIG. 1*a'* shows the rearward end of section 10*a*, after severing and stripping, with metallic or base wire 100 projecting from sheathing 100'.

After the stripped formed end of wire 10 is retracted from the cutter zone 15, the robot arm 14*a* is then swung counterclockwise about axis 20 (normal to axis 19), as by a drive including a motor 50, robot arm shaft 51, pulleys 52 and 53, and belt 54, and through an angle to FIG. 6 position. The wire 10 is again controllably fed endwise to advance the cut wire end 10' into a first press 16, where a terminal 17 is pressed (connected) onto the exposed (stripped) wire end. See FIG. 7. The "terminator" 18 to effect such terminal connections onto the wire is known, an example being described in said U.S. Pat. No. 4,446,615. The terminal 17 may for example be forked, as illustrated.

The left portion of FIG. 8 shows the wire end 10', terminated at 17, being retracted from the first press, under control of the wire feed 13; and FIG. 9 shows the robot arm 14*a* swung clockwise about axis 20, back to initial position, for positioning wire 10 to be advanced forwardly along axis 19 to the position of wire section 10*a* in FIG. 4, and subsequently to be severed and advanced forwardly (by 13) to FIG. 5 position. Note that in FIGS. 4, 5 and 9 a "final" robot 21 receives the wire section 10*a* for processing. Jaws 22 of that robot are open as the wire 10*a* is advanced forwardly to FIG. 4 position, following which the cutter at station 15 is operated to cut and thereby separate wire section 10*a* from wire 10, and the jaws 22 are then closed to permit the cut wire section 10*a* to be bodily traveled or advanced to the right, with robot 21, to FIG. 5 position. This assures bodily separation of 10*a* from 10.

FIG. 6 shows the robot 21 as rotated counterclockwise through an angle $\beta$, to rotate a rearward section 100*a* of wire 10*a* through that angle, and into alignment with a second terminal 23 supplied by the second terminator 24.

FIG. 7 shows the wire end 100*a* advanced, by the robot 21, into position in the terminator 24 enabling operation of the latter to connect terminal 23 to that wire end, as by clamp-on motion of the terminator. An example is described in U.S. Pat. No. 4,446,615.

FIG. 8 shows wire 10*a* endwise bodily displacement, by the robot 21, to retract the terminal 23 and wire end 100*a* from the terminator 24, followed by clockwise rotation of the second robot through angle $\beta$, to the position seen in FIG. 9. The wire is then dropped, by opening jaws 22 of the second robot, onto a conveyor 26, so as to be traveled rightwardly in FIG. 1 to a stack. Note the loop or "0" shape of the terminal 23.

DETAILED DESCRIPTION

The construction and apparatus of the second or "final" robot 21 will be described first. It basically comprises apparatus for handling wire subject to displacement and includes:

a) first means including a first Geneva mechanism for rotatably displacing the wire to alter its endwise orientation, b) second means including a second Geneva mechanism for displacing the wire endwise, c) and drive means for driving the two mechanisms in such relation that the wire is displaced endwise by a carrier part of the second means during a dwell period of the first mechanism.

As shown, the first Geneva mechanism is indicated at 30 in FIGS. 11, 12, and 17, and includes a driven rotor 31 having multiple like lobes 32, each of which defines a radially extending slot 33. Six such like lobes and slots are seen in FIG. 12 and 17, spaced about a rotor axis 34 at equal intervals; however, other numbers of lobes and slots may be used. The mechanism also includes a drive pin 35 eccentrically carried by a drive rotor 36 rotatable on an axle 37 carried by plates 38 and 39 of housing 40. A drive to rotate the rotor 36 includes a servo motor 41 (mounted by housing 40), a pulley 42 driven by the motor shaft 41*a*, a timing belt 43 driven by the pulley 42, and a gear 44 connected with rotor 36 and driven by the belt. As the gear is rotated, say at a steady angular rate, the pin 35 enters a slot 33, radially, while the rotor 31 dwells, then travels therein to rotate the rotor through angle $\emptyset$, and then radially leaves the slot while the rotor 31 again dwells.

The rotor 31 continues to dwell while the pin 35 rotates outside the rotor 31 through angle $\Delta$, and during that time interval, an outwardly convex, semicircular keeper rotor 44*a* rotates in close association with a concave surface 31*a* of rotor 31 defined between successive lobes to keep the rotor 31 in dwell position until the pin enters the next (in angular succession) slot. Thus, an intermittent rotation of rotor 31 is provided, and characterized by angular acceleration and deceleration during intervals of rotation, without need for stops to receive actuator-produced impacts to stop rotor rotation at the ends of angular intervals $\beta$, where $\beta=(360^\circ-\Delta)$, or stops to limit rotation of robot 21.

Included within the first means for rotatably displacing the wire to alter its rotation is a first transmission operatively connected between the Geneva mechanism 30 and structure, such as a slide 46, that carries wire gripping jaws 22. That slide is mounted via linear bearings 47 and 48 on a plate 49 that is in turn carried by and fixed to a tubular shaft 50 connected with Geneva rotor 31. Therefore, plate 49 and slide 46 are intermittently rotated by the Geneva mechanism back and forth through angle B as described above, with dwell intervals therebetween.

The second Geneva mechanism to rotate for displacing the wire endwise is indicated at 80 in FIG. 11, and includes a driven rotor 51 which is like rotor 31, i.e., has the same number of lobes 52 and radial slots 53, these being in axial alignment (as respects common axis 59) with the lobes and slots of the rotor 31. A drive pin 55 eccentrically carried by a drive rotor 56 is rotatable on axle 37 (which carries drive rotor 36). Motor 41 also rotates the rotor 56, via pulley 62 driven by shaft 41*a*, timing belt 67 driven by pulley 62, and a gear 64 connected with rotor 56 and driven by belt 63. As gear 64 is rotated, at a steady angular rate, pin 55 enters a slot 53, radially, while rotor 51 dwells along with rotor 31, then travels in that slot to rotate rotor 51, and then radially leaves slot 53, while the two rotors again dwell.

FIG. 18 shows the use of two arcuate rotor sections 84 and 85 on 56 to closely fit the concave surface 86 of 51 to prevent its rotation when pins 55 and 55*a* are out of slots 53.

Included within the second means for displacing the wire endwise, as between FIG. 4 and FIG. 5 positions, and also between FIG. 6 and FIG. 7 positions, is a second transmission operatively connected between the Geneva mechanism 80 and structure such as a slide 46, as previously referred to. The second transmission may advantageously include a shaft 66 connected with rotor 51 and projecting upwardly and coaxially within the tube 50, through plate 49. See beearing 110 for shaft 66, and bearing 111 for shaft 50. A camming arm 67 is connected to the top of the shaft 66, and extends radially therefrom. A cam 67a is carried by the arm to project within a cam slot 68 in the slide plate 46a. Slot 68 extends linearly, as seen in FIGS. 4–7, and the arm 67 extends normal to the length dimension of the slot (i.e., is centered therein) while the robot slide is rotated through angle $\beta$ from FIG. 6 position. This relationship occurs because of the simultaneous rotation of the two Geneva rotors 31 and 51 through angle $\beta$. In other words, the cam 67a does not rotate relative to, or travel along, the slot 68 as the robot 21 is rotated through angle $\beta$.

However, the cam is rotated relative to the slot to retract the slide 46 from FIG. 4 to FIG. 5 positions, and also to advance the slide from FIG. 6 to FIG. 7 position, while the Geneva rotor 30 is held in its dwell position. This is effected by providing a second drive pin 55a on the rotor 51. That pin is indicated in broken lines in FIG. 12, as generally diametrically opposite (relative to shaft 37) the pin 55 (which lies in alignment with pin 35). Pin 55a is rotated into a slot 53 of the second Geneva rotor to rotate shaft 66 while shaft 50 is held against rotation, as described above. Therefore, relative rotation of cam 67a in slot 68 occurs.

Further, after the wire end has been terminated at 23 in FIG. 7, the stepping motor 41 is reversed, and the reverse sequence of steps and motions of the robot 21 occurs, i.e., retraction of the robot to FIG. 8 position, clockwise rotation of the robot 21 to FIG. 9 position, and return displacement of the robot 21 to FIG. 4 position. In FIG. 9 position, the jaws 22 are opened, and the wire section 10a, terminated at both ends, is dropped into a conveyor 26 to be transported away from the apparatus, for storage or stacking.

Referring to FIGS. 15 and 16, the jaws 22 are pivotally supported at 70, on structure 71, carried by the slide 46. Means to open and close (actuate) the jaws includes a wedge-shaped cam 72 moved linearly back and forth in the direction of arrows 73, as by an actuator 74. Cam followers 75 on the jaw arms 22a travel in the cam slots 72a defined by 72, the slots angled as shown to effect opening and closing of the jaws as the actuator shaft 74a moves to the right and left.

Also shown is a master control 95 operatively connected to the wire feed, the step motor, the drives for the terminators, and to the jaw actuator 74, to synchronize their operations in the manner as described.

I claim:

1. In apparatus for processing wire subject to displacement, the combination comprising a) first means including a first Geneva mechanism for rotatably displacing the wire to alter its endwise orientation, b) second means including a second Geneva mechanism for displacing the wire endwise, c) and drive means for driving said two mechanisms in such relation that the wire is displaced endwise by a carrier part of said second means during a dwell period of said first mechanism.

2. The combination of claim 1 wherein each of said Geneva mechanisms has driving and driven parts characterized in that the driven parts of both mechanisms are rotated during operation of the first Geneva mechanism to rotate the wire to alter its endwise orientation, and the driven part of the first Geneva mechanism dwells during operation of the second Geneva mechanism to displace the wire endwise.

3. The combination of claim 2 wherein said drive means simultaneously drives the driving parts of said two Geneva mechanisms.

4. The combination of claim 1 wherein said two Geneva mechanisms have driven parts with slots that are coaxially driven.

5. The combination of claim 2 wherein said driving means includes a reversible drive for simultaneously driving the driving parts of both Geneva mechanisms sequentially forwardly and reversely whereby the wire is:

i) rotatably displaced counterclockwise, ii) then advanced endwise, iii) then retracted endwise, iv) and finally rotatably displaced clockwise.

6. The combination of claim 5 wherein said driven parts of the two Geneva mechanisms are coaxially driven.

7. The combination of claim 5 wherein the wire has an end portion, and including means for modifying the wire end portion after the wire is advanced endwise and before the wire is retracted endwise.

8. The combination of claim 2 wherein said driven parts of the two Geneva mechanisms are mounted coaxially.

9. The combination of claim 8 including a linearly movable part operable to displace the wire endwise, wherein the driven part of the second Geneva mechanism is operatively connected with said linearly movable part via an operative connection that extends through the driven part of the first Geneva mechanism.

10. The combination of claim 9 wherein said operative connection includes a shaft extending through said driven part of the first Geneva mechanism, a cam connected with said shaft, and a cam follower engaged by the cam and operatively connected with said linearly movable part.

11. The combination of claim 1 wherein said driving means comprises a single motor driven both Geneva mechanisms.

* * * * *